US008235739B2

(12) United States Patent
Hashimoto

(10) Patent No.: US 8,235,739 B2
(45) Date of Patent: Aug. 7, 2012

(54) ELECTRICAL CONNECTOR

(75) Inventor: Yoshimitsu Hashimoto, Tokyo (JP)

(73) Assignee: Dai-Ichi Seiko Co., Ltd. (JP)

( * ) Notice: Subject to any disclaimer, the term of this patent is extended or adjusted under 35 U.S.C. 154(b) by 169 days.

(21) Appl. No.: 12/857,932

(22) Filed: Aug. 17, 2010

(65) Prior Publication Data

US 2011/0086541 A1 Apr. 14, 2011

(30) Foreign Application Priority Data

Oct. 14, 2009 (JP) ..... 2009-237045

(51) Int. Cl.
*H01R 13/62* (2006.01)

(52) U.S. Cl. ..... 439/328; 439/357

(58) Field of Classification Search ..... 439/328, 439/327, 325, 357, 495
See application file for complete search history.

(56) References Cited

U.S. PATENT DOCUMENTS 6,089,905 A * 7/2000 Shimmyo et al. ..... 439/495
6,347,946 B1 * 2/2002 Trobough et al. ..... 439/70
7,507,112 B2 * 3/2009 Mundt ..... 439/495

FOREIGN PATENT DOCUMENTS

JP 2008-052993 A 3/2008
JP 2008-192574 A 8/2008

* cited by examiner

*Primary Examiner* — Phuong Dinh
(74) *Attorney, Agent, or Firm* — Studebaker & Brackett PC; Donald R. Studebaker

(57) ABSTRACT

An electrical connector comprising a housing provided with an opening through which an FPC is inserted into the housing, a plurality of conductive contacts arranged on the housing for coming into contact with signal connecting terminals on the FPC inserted in the housing, and a conductive shell mounted on the housing and provided therein with a holding member operative to hold the FPC inserted in the housing and a releasing member extending from the holding member to be operative to release the FPC from holding by the holding member, wherein the holding member includes an engaging projection for engaging with an engaging edged portion provided on the FPC inserted in the housing and the releasing member includes a handle portion positioned on the outside of the housing to be handled for causing the engaging projection of the holding member to disengage from the engaging edged portion on the FPC inserted in the housing.

7 Claims, 12 Drawing Sheets

ELECTRICAL CONNECTOR

BACKGROUND OF THE INVENTION

1. Field of the Invention

The present invention relates generally to an electrical connector, and more particularly to an improvement in an electrical connector which has a housing, holding means for engaging with a flat circuit device, such as a flexible printed circuit board (hereinafter, referred to as an FPC) or a flexible flat cable assembly (hereinafter, referred to as an FFC) inserted in the housing, so as to hold the same to be prevented from getting out of the housing unwillingly and a plurality of conductive contacts provided for coming into contact with connecting terminals provided on the flat circuit device so as to put the flat circuit device in electrical connection with another electrical device, such as a main solid circuit board.

2. Description of the Prior Art

A flat circuit device, such as a relatively small-sized FPC or FFC, used in various kinds of electronic apparatus is often mounted on a main solid circuit board, on which various electrical parts are directly mounted, with an electrical connector which is fixed to and connected electrically with the main solid circuit board. The electrical connector has a plurality of conductive contacts, an end portion of each of which is connected electrically with a conductive circuit pattern portion formed on the main solid circuit board and which are provided for coming into contact with connecting terminals provided on the flat circuit device, and is operative to connect electrically, through the conductive contacts, each of the connecting terminals provided on the flat circuit device with the conductive circuit pattern portion formed on the main solid circuit board.

A first type of previously proposed electrical connector used for mounting a flat circuit device, such as an FPC, on a main solid circuit board, is provided with a housing made of insulator, which is fixed on the main solid circuit board and has an opening through which at least a part of the flat circuit device is inserted into the housing. In the housing, a plurality of conductive contacts are provided to be arranged along the opening provided on the housing. These conductive contacts are operative to come into contact respectively with a plurality of connecting terminals provided on the flat circuit device when the flat circuit device is inserted in the housing through the opening provided thereon. The previously proposed electrical connector of the first type is also provided with a conductive shell which covers partially the housing and is grounded to be operative to contribute to adjustment on characteristic impedance of each of the conductive contacts and to shield the conductive contacts in the housing from electromagnetic wave noises coming from the outside. The previously proposed electrical connector of the first type is further provided with an actuator which is provided to be rotatable in regard to the housing so as to engage with each of the conductive contacts arranged in the housing. When the actuator is rotated in a first direction in regard to the housing, an operating portion of each of the conductive contacts is moved by the actuator to put the conductive contact in press-contact with a corresponding one of the connecting terminals provided on the flat circuit device, and then, when the actuator is rotated in a second direction opposite to the first direction in regard to the housing, the conductive contacts put in press-contact with the connecting terminals provided on the flat circuit device are released from the press-contact with the connecting terminals. With the conductive contacts put in press-contact with the connecting terminals provided on the flat circuit device, the flat circuit device is put in electrical connection with the main solid circuit board.

A second type of previously proposed electrical connector used for mounting the flat circuit device on the main solid circuit board is provided with a housing to be fixed on the main solid circuit board, a plurality of conductive contacts and a conductive shell in such a manner as mentioned above but is not provided with an actuator rotatable in regard to the housing. In the previously proposed electrical connector of the second type, when the flat circuit device is inserted into the housing through an opening provided thereon, each of the conductive contacts provided in the housing to be arranged along the opening is automatically put in press-contact with a corresponding one of connecting terminals provided on the flat circuit device. That is, the flat circuit device is put in electrical connection with the main solid circuit board by means of only inserting correctly the flat circuit device into the housing through the opening provided thereon.

In the previously proposed electrical connector with or without the actuator rotatable in regard to the housing, when the flat circuit device is inserted into the housing through the opening provided thereon and the conductive contacts provided in the housing are put in press-contact with the connecting terminals provided on the flat circuit device so that the flat circuit device is put in electrical connection with the main solid circuit board, it is required to prevent the flat circuit device inserted in the housing from getting out of the housing unwillingly. It is a matter of course that it is necessary for the flat circuit device inserted in the housing to be held stably so as not to get out of the housing unwillingly in order to keep the conductive contacts provided in the housing properly in a condition of press-contact with the connecting terminals provided on the flat circuit device.

There has been also proposed previously an electrical connector belonging to the above mentioned first type having the housing, the conductive contacts, the conductive shell and the actuator, which is provided also with holding means for engaging with a flat circuit device, such as an FPC or an FFC, inserted in the housing so as to hold the same to be prevented from getting out of the housing unwillingly, as shown in, for example, the Japanese patent application published before examination under publication number 2008-52993 (hereinafter, referred to as published patent document 1).

Besides, there has been further proposed previously an electrical connector belonging to the above mentioned second type having the housing, the conductive contact and the conductive shell except the actuator rotatable in regard to the housing, which is provided also with holding means for engaging with a flat circuit device, such as an FPC or an FFC, inserted in the housing so as to hold the same to be prevented from getting out of the housing unwillingly, as shown in, for example, the Japanese patent application published before examination under publication number 2008-192574 (hereinafter, referred to as published patent document 2).

In the electrical connector shown in the published patent document 1, the holding means (a locking portion 11*c*) is formed in a part of the conductive shell (a shield plate 11) to be able to seesaw with an engaging end portion (a nail portion 11*d*) curved to the inside of the conductive shell. The holding means shifts its position in response to a movement of the actuator (an actuator 9) provided to be rotatable in regard to the housing (a housing 3).

Then, when the actuator is rotated in a first direction in regard to the housing after the flat circuit device (an FPC 21) is inserted into a receiving space (an FPC receiving space 34) provided in the housing, each of the conductive contacts (first contacts 5 and second contacts 6) provided in the housing is caused by a cam (a cam portion 92 or 93) formed on the actuator to shift its position so as to be put in press-contact with a corresponding one of connecting terminals provided on the flat circuit device inserted in the housing and the holding means is caused by a cam (a cam portion 94) formed on the actuator to shift its position so as to cause the engaging end portion of the holding means to engage with an engaging portion (a recess 21*a*) formed on the flat circuit device. As a result, the flat circuit device inserted in the housing is prevented from getting out of the housing unwillingly.

After that, when the actuator is rotated in a second direction opposite to the first direction in regard to the housing under a condition wherein the engaging end portion of the holding means is put in engagement with the engaging portion formed on the flat circuit device, the cam (the cam portion 94) formed on the actuator allows the holding means to release the engaging end portion of the holding means from the engagement with the engaging portion formed on the flat circuit device. As a result, the flat circuit device is put in a condition to be able to get out of the housing.

Further, in the electrical connector shown in the published patent document 2, the conductive shell (a shell 4) is provided to be rotatable in relation to the housing (a housing body 2) and the holding means (a leg portion 46) in the form of a leaf spring is formed in a part of the conductive shell. The holding means has an engaging projection (44) formed at an end of the holding means to be curved to the inside of the conductive shell.

When the flat circuit device (an FPC) is inserted into the housing through the opening (an opening 21) provided thereon under a condition wherein the conductive shell is positioned to keep lying down on the housing so as to be close in its entirety to the housing, each of the conductive contacts (upper contacts 31 and lower contacts 32) provided in the housing is caused to be put in press-contact with a corresponding one of connecting terminals provided on the flat circuit device inserted in the housing and the engaging projection formed on the holding means is caused to engage with an engaging portion (an FPC engaging hole 2) provided on the flat circuit device. As a result, the flat circuit device inserted in the housing is prevented from getting out of the housing unwillingly.

After that, when the conductive shell is rotated to be positioned to keep rising from the housing under a condition wherein the engaging projection formed on the holding means is put in engagement with the engaging portion formed on the flat circuit device, the holding means formed in the conductive shell shifts its position in response to a movement of the conductive shell so as to release the engaging projection provided on the holding means from the engagement with the engaging portion formed on the flat circuit device. As a result, the flat circuit device is put in a condition to be able to get out of the housing.

In each of the electrical connectors thus proposed previously, which has the holding means operative to prevent the flat circuit device inserted in the housing from getting out of the housing unwillingly, the holding means is provided to be operative to shift its position in response to rotational movements of the actuator provided to be rotatable in regard to the housing, or the conductive shell for covering partially the housing is provided to be rotatable in regard to the housing and the holding means is formed in a part of the conductive shell to be operative to prevent the flat circuit device inserted in the housing from getting out of the housing unwillingly.

In the case of the previously proposed electrical connector which has the holding means operative to shift its position in response to the rotational movements of the actuator provided to be rotatable in regard to the housing, it is required that the holding means and the actuator are provided as separate parts independent from each other and this results in problems or disadvantages that the number of constitutive parts of the electrical connector increases undesirably and a production cost of the electrical connector rises disagreeably. Besides, it is necessary, for causing the holding means to engage with or disengage from the flat circuit device inserted in the housing, to rotate the actuator in regard to the housing and this results in undesirable increase in an open space around the electrical connector.

In the case of the previously proposed electrical connector which has the conductive shell provided to be rotatable in regard to the housing and the holding means formed in the part of the conductive shell, since the conductive shell is operative to rotate in regard to the housing, any part of the conductive shell can not be used for fastening the electrical connector to the main solid circuit board so that a separate holding-down member for fastening the electrical connector to the main solid circuit board is required and this results in problems or disadvantages that the number of constitutive parts of the electrical connector increases undesirably and a production cost of the electrical connector rises disagreeably.

Further, in each of the above-mentioned previously proposed electrical connectors, which is provided with the holding means operative to prevent the flat circuit device inserted in the housing from getting out of the housing unwillingly, the holding means, which is put in operation to prevent the flat circuit device inserted in the housing from getting out of the housing unwillingly, assumes a posture which is entirely or almost the same as a posture assumed by the holding means which is not put in operation to prevent the flat circuit device inserted in the housing from getting out of the housing unwillingly or takes up a position which is entirely or almost the same as a position taken up by the holding means which is not put in operation to prevent the flat circuit device inserted in the housing from getting out of the housing unwillingly. Further, the flat circuit device, which is inserted in the housing and prevented by the holding means from getting out of the housing unwillingly, assumes a posture which is entirely or almost the same as a posture assumed by the flat circuit device which is inserted in the housing but not prevented by the holding means from getting out of the housing unwillingly.

This means that, with the above-mentioned previously proposed electrical connector put to practical use, it is very difficult to confirm quickly and accurately by means of visual check or sentient check from the outside of the electrical connector that the flat circuit device inserted in the housing has reached an appropriate position in the housing to be surely prevented by the holding means from getting out of the housing unwillingly. Accordingly, particular additional operations are required for confirming that the flat circuit device inserted in the housing has been put in an appropriate condition to be connected electrically with, for example, a main solid circuit board to which the electrical connector is fixed with electrical connection. This results in problems or disadvantages that the number of steps of work for producing the electrical connector increases and the production cost of the electrical connector rises.

OBJECTS AND SUMMARY OF THE INVENTION

Accordingly, it is an object of the present invention to provide an electrical connector used for mounting a flat circuit device, such as an FPC or an FFC, on a solid circuit board, which comprises a housing provided thereon with an opening through which a flat circuit device is inserted into the housing, a plurality of conductive contacts provided to be arranged on the housing and a conductive shell covering partially the housing, and which avoids the aforementioned disadvantages encountered with the prior art.

Another object of the present invention is to provide an electrical connector used for mounting a flat circuit device, such as an FPC or an FFC, on a solid circuit board, which comprises a housing provided thereon with an opening through which a flat circuit device is inserted into the housing, a plurality of conductive contacts provided to be arranged on the housing and a conductive shell covering partially the housing, and in which the flat circuit device inserted in the housing can be put in holding by a holding member formed in the conductive shell to be surely prevented from getting out of the housing unwillingly and then released from the holding by the holding member to be able to get out of the housing with a structure in which the number of structural parts can be reduced.

A further object of the present invention is to provide an electrical connector used for mounting a flat circuit device, such as an FPC or an FFC, on a solid circuit board, which comprises a housing provided thereon with an opening through which a flat circuit device is inserted into the housing, a plurality of conductive contacts provided to be arranged on the housing and a conductive shell covering partially the housing, and with which it can be very easily, quickly and accurately confirmed by means of visual check or sentient check from the outside of the electrical connector that the flat circuit device inserted in the housing has reached an appropriate position in the housing to be surely prevented from getting out of the housing unwillingly by a holding member formed in the conductive shell.

According to the present invention, as claimed in any one of claims, there is provided an electrical connector, which comprises a housing provided thereon with an opening through which a flat circuit device, such as an FPC or an FFC, is inserted into the housing, a plurality of conductive contacts provided to be arranged on the housing and positioned to correspond respectively to connecting terminals provided on the flat circuit device inserted in the housing through the opening provided thereon, and a conductive shell mounted on the housing for covering partially the same and provided with a holding member formed in a body therein and operative to be put in engagement with the flat circuit device inserted in the housing for holding the same and a releasing member formed in a body therein and operative to release the holding member from the engagement with the flat circuit device inserted in the housing, wherein the holding member formed in the conductive shell comprises an arm portion extending from the conductive shell to the inside of the housing and an engaging projection provided at an end of the arm portion for engaging with an engaging edged portion provided on the flat circuit device inserted in the housing, and the releasing member formed in the conductive shell comprises a connecting portion extending from the end of the arm portion, a contacting portion held by the connecting portion to be positioned on the outside of the housing for coming into contact with an outer surface of the housing or the conductive shell and a handle portion extending from the contacting portion on the outside of the housing and operative to be handled for releasing the holding member from the engagement with the flat circuit device inserted in the housing.

In the electrical connector thus constituted in accordance with the present invention, when the flat circuit device on which the connecting terminals are provided is inserted into the housing thorough the opening provided thereon, each of the conductive contacts provided to be arranged in the housing comes into press-contact with the corresponding one of the connecting terminals provided on the flat circuit device inserted in the housing and the engaging projection provided at the end of the arm portion of the holding member formed in the conductive shell engages with the engaging edged portion provided on the flat circuit device inserted in the housing. As a result, the flat circuit device inserted in the housing is held by the holding member so as to be prevented from getting out of the housing unwillingly and the conductive contacts are stably kept in press-contact with the connecting terminals provided on the flat circuit device inserted in the housing.

Then, when the handle portion of the releasing member formed in the conductive shell in addition to the holding member is handled, for example, pressed down toward the housing, to release the holding member from the engagement with the flat circuit device inserted in the housing, the releasing member operates to shift the end of the arm portion of the holding member connected with the connecting portion of the releasing member so as to cause the engaging projection provided at the end of the arm portion to disengage from the engaging edged portion provided on the flat circuit device inserted in the housing. As a result, the flat circuit device inserted in the housing is released from holding by the holding member so as to be able to get out of the housing.

Functions or roles of the respective portions of the electrical connector constituted as mentioned above in accordance with the present invention are further explained in the concrete as follows, for example.

In the electrical connector according to the present invention, the arm portion of the holding member is, for example, formed to be resilient and movable, such as that described in one of the claims, and the engaging projection of the holding member is, for example, formed to have a contacting surface operative to come into contact with an edge of the flat circuit device which is on the way of insertion into the housing through the opening provided thereon, such as that described in another of the claims.

When the contacting surface provided on the engaging projection of the holding member comes into contact with the edge of the flat circuit device, the arm portion of the holding member is resiliently moved along one of a pair of surfaces opposite each other of the flat circuit device inserted in the housing to go away from the flat circuit device so that the flat circuit device is able to be smoothly and continuously inserted into the housing through the opening provided thereon without obstruction by the holding member.

On that occasion, the connecting portion of the releasing member connected with the end of the arm portion of the holding member is, for example, moved also along the surfaces opposite each other of the flat circuit device inserted in the housing to go away from the flat circuit device and thereby the handle portion of the releasing member shifts its position on the outside of the housing to leave its original position. As a result, a condition wherein the flat circuit device is not held by the holding member in the housing can be easily confirmed by means of checking visually or sentiently the position of the handle portion of the releasing member on the outside of the housing.

Then, when the flat circuit device has reached a predetermined position in the housing, the contacting surface provided on the engaging projection of the holding member is apart from the edge of the flat circuit device inserted in the housing and thereby the arm portion of the holding member accompanied with the engaging projection moves resiliently along the surfaces of the flat circuit device inserted in the housing to approach the circuit device so that the engaging projection engages with an engaging edged recess provided on the flat circuit device inserted in the housing, such as that described in one of the claims. As a result, the holding member is put in a condition to hold the flat circuit device inserted in the housing.

On that occasion, the connecting portion of the releasing member connected with the end of the arm portion of the holding member is moved also along the surfaces of the flat circuit device inserted in the housing to approach the circuit device inserted in the housing to approach the flat circuit device and thereby the handle portion of the releasing member shifts its position on the outside of the housing to return to its original position. As a result, a condition wherein the flat circuit device is held by the holding member in the housing can be easily confirmed by means of checking visually or sentiently the position of the handle portion of the releasing member on the outside of the housing.

After that, when the handle portion of the releasing member is, for example, pressed toward the housing, such as that described in one of the claims, the connecting portion of the releasing member accompanied with the engaging projection of the holding member is moved along the surface of the flat circuit device inserted in the housing to go away from the circuit device and thereby the engaging projection of the holding member disengages from the engaging edged recess provided on the flat circuit device. As a result, the flat circuit device inserted in the housing is put in a condition to be able to get out of the housing.

Incidentally, in an embodiment of electrical connector according to the present invention, such as that claimed in one of the claims, a couple of groups of the holding member and the releasing member are provided respectively at portions of the conductive shell corresponding to end portions of the housing opposite each other in a direction along which the conductive contacts are arranged on the housing.

With the electrical connector constituted in accordance with the present invention, as described above, when the flat circuit device, such as the FPC, the FTC and so on, is inserted into the housing thorough the opening provided thereon, each of the conductive contacts provided to be arranged in the housing comes into press-contact with the corresponding one of the connecting terminals provided on the flat circuit device inserted in the housing and the engaging projection of the holding member formed in the conductive shell engages with the engaging edged portion provided on the flat circuit device inserted in the housing. As a result, the flat circuit device inserted in the housing is held by the holding member so as to be prevented from getting out of the housing unwillingly and the conductive contacts are stably kept in press-contact with the connecting terminals provided on the flat circuit device inserted in the housing.

Then, when the handle portion of the releasing member formed in the conductive shell in addition to the holding member is handled to release the holding member from the engagement with the flat circuit device inserted in the housing under a condition wherein the flat circuit device inserted in the housing is put in holding by the holding member, the releasing member operates to cause the engaging projection of the holding member to disengage from the engaging edged portion provided on the flat circuit device inserted in the housing so that the holding member is released from the engagement with the flat circuit device. As a result, the flat circuit device inserted in the housing is released from the holding by the holding member so as to be able to get out of the housing.

Accordingly, with the electrical connector according to the present invention, the flat circuit device inserted in the housing can be put in the holding by the holding member formed in the conductive shell to be surely prevented from getting out of the housing unwillingly and then released from the holding by the holding member to be able to get out of the housing with an improved structure in which the number of structural parts can be reduced.

Further, in the electrical connector according to the present invention, the position on the outside of the electrical connector, at which the handle portion of the releasing member formed in the conductive shell is put when the engaging projection of the holding member formed in the conductive shell is put in the engagement with the engaging edged recess provided on the flat circuit device so that the holding member is put in the condition to hold the flat circuit device, is different from the position on the outside of the electrical connector, at which the handle portion of the releasing member is put when the engaging projection of the holding member is released from the engagement with the engaging edged recess provided on the flat circuit device so that the holding member is out of the condition to hold the flat circuit device. Consequently, it can be easily, quickly and accurately confirmed by means of visual check or sentient check from the outside of the electrical connector that the flat circuit device inserted in the housing has reached the appropriate position in the housing to be surely prevented from getting out of the housing unwillingly by the holding member formed in the conductive shell.

The above, and other objects, features and advantages of the present invention will become apparent from the following detailed description taken in conjunction with the accompanying drawings.

DESCRIPTION OF THE PREFERRED EMBODIMENT

Figure 1:
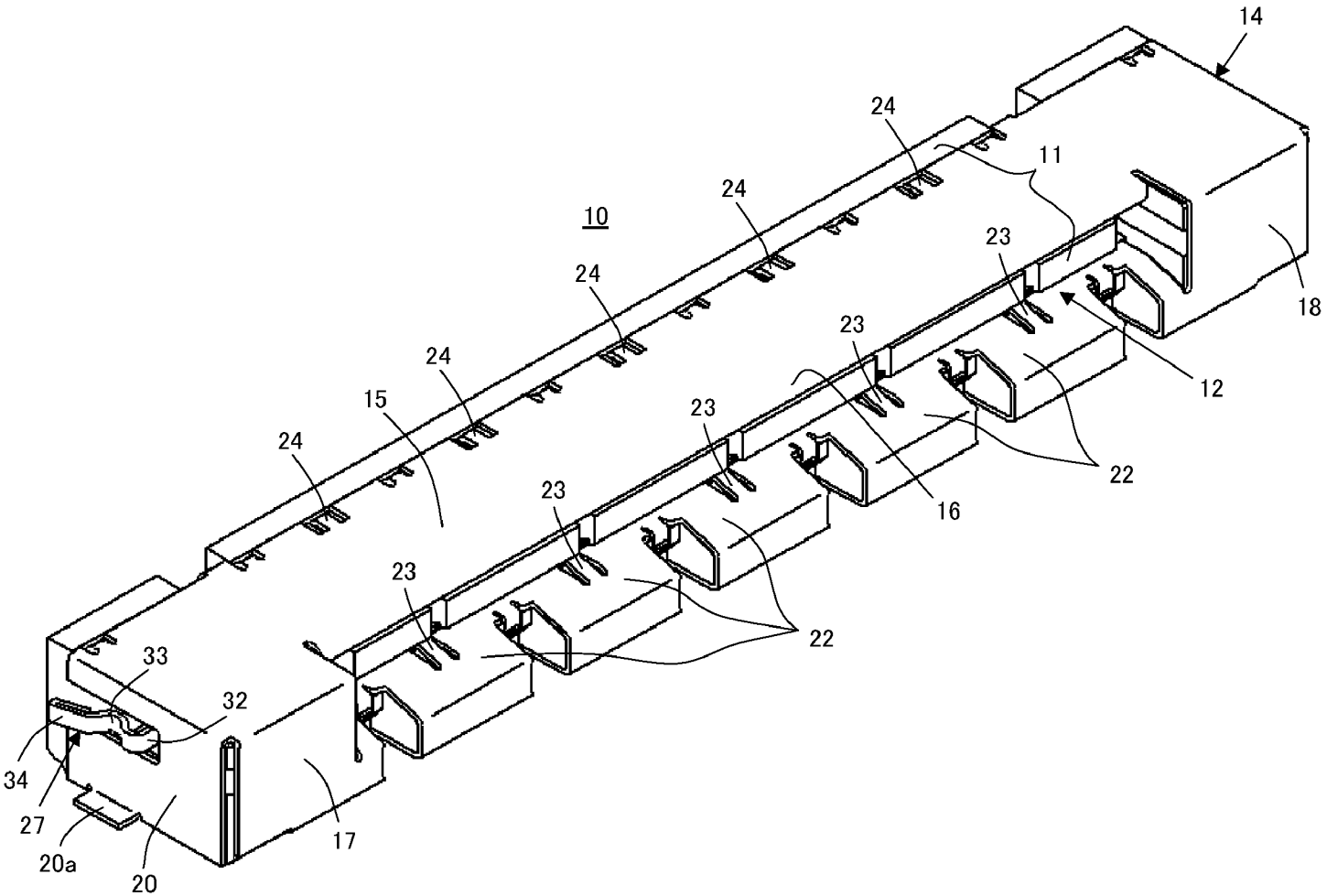
FIG. 1 is a schematic front, top and left side perspective view showing an embodiment of electrical connector according to the present invention.
Figure 2:
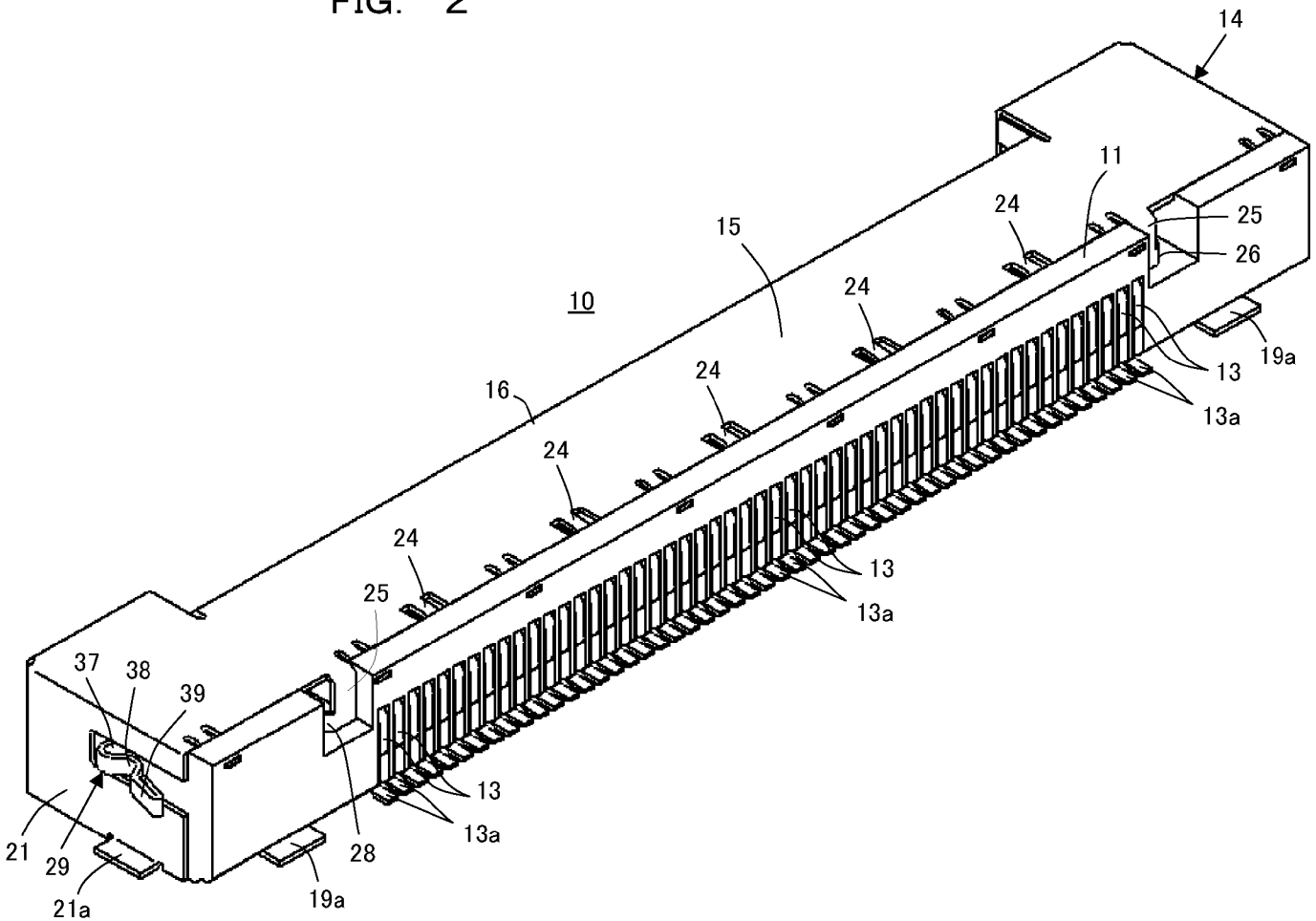
FIG. 2 is a schematic rear, top and left side perspective view showing the embodiment shown in FIG. 1.
Figure 3:
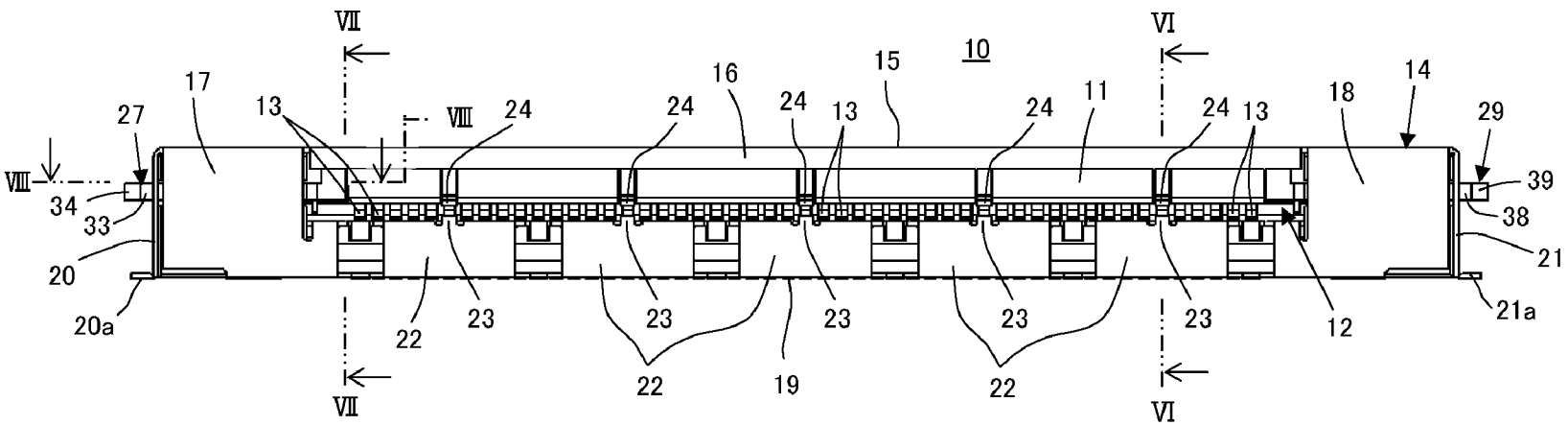
FIG. 3 is a schematic front view showing the embodiment shown in each of FIGS. 1 and 2.

Each of FIG. 1 which is a schematic front, top and left side perspective view, FIG. 2 which is a schematic rear, top and left side perspective view and FIG. 3 which is a front view, shows an embodiment of electrical connector according to the present invention.

Referring to FIGS. 1 to 3, an electrical connector 10, which constitutes the embodiment of electrical connector according to the present invention, has a housing 11 made of, for example, insulator such as plastics or the like. The housing 11 is provided thereon with an opening 12 which extends from a front end portion of the housing to an inside of the housing 11 and through which, for example, an FPC constituting a flat circuit device as explained later is inserted into the housing 11. When the electrical connector 10 is put in practical use, the housing 11 is mounted on a solid circuit board in an electronic apparatus (not shown in the drawings) so that the electrical connector 10 is fixed in its entirety to the solid circuit board.

A plurality of conductive contacts 13, each of which is made of resilient conductive material, are provided on the housing 11 of the electrical connector 10 to be arranged in a longitudinal direction of the housing 11. Each of the conductive contacts 13 constitutes, for example, a signal contact operative to come into press-contact with a signal connecting terminal provided on the FPC. It is also possible that the conductive contacts 13 include, in addition to the signal contacts, one or more ground contacts operative to come into press-contact with a ground connecting portion provided on the FPC. Further, each of the conductive contact 13 has a connecting terminal 13*a* projecting from a rear end portion of the housing 11 to the outside thereof, as shown in FIG. 2. The connecting terminal 13*a* of the conductive contact 13 is connected electrically with a signal terminal provided on the solid circuit board on which the housing 11 is mounted. These conductive contacts 13 are, for example, thrust into the housing 11 from the rear end portion thereof shown in FIG. 2 when the electrical connector 10 is assembled.

When the FPC is inserted into the housing 11 through the opening 12 provided thereon, the conductive contacts 13 come into press-contact with the signal connecting terminals provided on the FPC inserted in the housing 11, respectively. Therefore, the signal connecting terminals provided on the FPC inserted in the housing 11 are electrically connected through the conductive contacts 13 with the signal terminals provided on the solid circuit board on which the housing 11 is mounted.

The electrical connector 10 has also a conductive shell 14 mounted on the housing 11 for covering an outer surface of the housing 11 except a part of the front end portion of the housing 11 surrounding the opening 12, the rear end portion of the housing 11, portions in the vicinity of the rear end portion of the housing 11, a part of each of left and right side end portions of the housing 11, and a part of a bottom end portion thereof. That is, the conductive shell 14 is provided for covering partially the housing 11.

The conductive shell 14 is formed by means of processing a metal thin plate and grounded to be operative to contribute to adjustment on characteristic impedance of each of the conductive contacts 13 and to shield the conductive contacts 13 on the housing 11 from electromagnetic wave noises coming from the outside.

Figure 4:
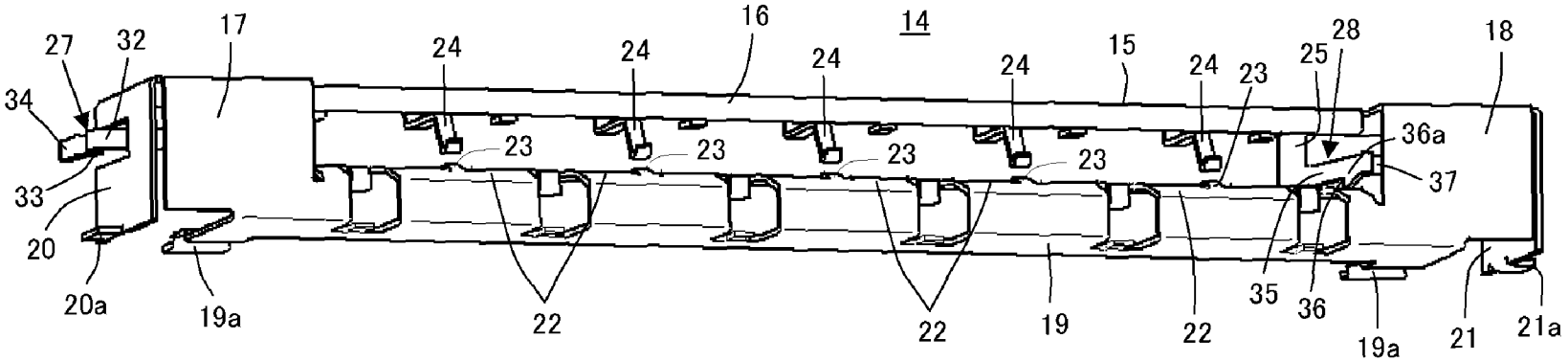
FIG. 4 is a schematic front, bottom and left side perspective view showing a conductive shell provided to be employed in the embodiment shown in each of FIGS. 1 and 2.
Figure 5:
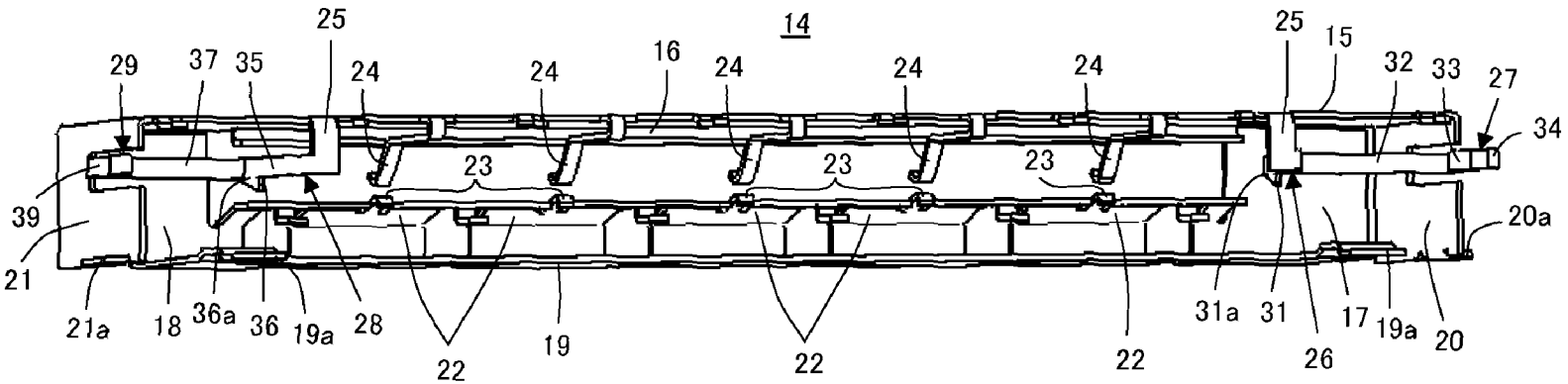
FIG. 5 is a schematic rear and left side perspective view showing the conductive shell shown in FIG. 4.

As shown in FIG. 4 which is a schematic front, bottom and left side perspective view showing the conductive shell 14 and in FIG. 5 which is a schematic front and left side perspective view showing the conductive shell 14, the conductive shell 14 is provided with an upper portion 15 for covering an upper end portion opposite to the bottom end portion of the housing 11 and further covering over a space in the inside of the housing 11 connected with the opening 12 provided on the housing 11, a front and upper end portion 16 for covering partially a part of the front end portion of the housing 11 positioned above the opening 12, a front and left end portion 17 for covering a part of the front end portion of the housing 11 positioned on the left side of the opening 12, a front and right end portion 18 for covering a part of the front end portion of the housing 11 positioned on the right side of the opening 12, a lower portion 19 for covering the bottom end portion of the housing 11, a left side portion 20 for covering partially the left side end portion of the housing 11 and a right side portion 21 for covering partially the right side end portion of the housing 11. The lower portion 19, the left side portion 20 and the right side portion 21 are provided with ground connecting terminals 19*a*, 20*a* and 21*a*, respectively. Each of the ground connecting terminals 19*a*, 20*a* and 21*a* is connected electrically, for example, by soldering with a grounded portion provided on the solid circuit board on which the housing 11 is mounted, so as to be operative to supply the conductive shell 14 with a ground potential from the solid circuit board and to be used for mounting the housing 11 on the solid circuit board.

Figure 6:
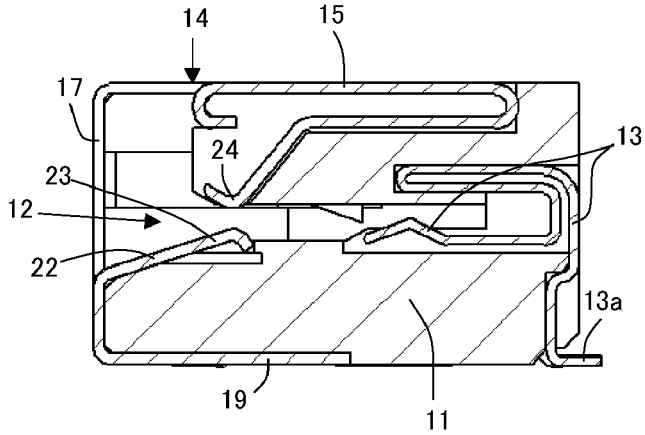
FIG. 6 is a schematic cross sectional view taken along line VI-VI on FIG. 3.

As shown clearly in FIG. 6 showing a cross section taken along line VI-VI on FIG. 3, the conductive shell 14 is also provided with a plurality of slanted guiding portions 22 formed therein, each of which extends from the lower portion 19 of the conductive shell 14 to form a slanted surface in the vicinity of the opening 12 provided on the housing 11, a plurality of first grounding contacts 23 formed therein, each of which constitutes a part of the slanted guiding portion 22, and a plurality of second grounding contacts 24 formed therein, each of which extends from a rear end of the upper portion 15 of the conductive shell 14 into the inside of the conductive shell 14 in the direction toward the opening 12.

The slanted guiding portion 22 is operative to guide with its slanted surface the FPC inserted through the opening 12 into the housing 11. The first grounding contact 23 is operative to come into press-contact with the ground connecting portion provided on the FPC inserted in the housing 11 from the side of the lower portion of the conductive shell 14 to be connected electrically with the ground connecting portion provided on the FPC. The second grounding contact 24 is operative to come into press-contact with the ground connecting portion provided on the FPC inserted in the housing 11 from the side of the upper portion of the conductive shell 14 to be connected electrically with the ground connecting portion provided on the FPC.

In the case where the FPC inserted in the housing 11 is not provided with the ground connecting portion on a part thereof facing the lower portion 19 of the conductive shell 14 but provided with the ground connecting portion only on another part thereof facing the upper portion 15 of the conductive shell 14, the first grounding contact 23 provided on the conductive shell 14 is operative to come into contact with the part of the FPC facing the lower portion 19 of the conductive shell 14 and the second grounding contact 24 provided on the conductive shell 14 is operative to come into contact with the ground connecting portion provided on the part of the FPC facing the upper portion 15 of the conductive shell 14. Further, in the case where the FPC inserted in the housing 11 is not provided with the ground connecting portion on a part thereof facing the upper portion 15 of the conductive shell 14 but provided with the ground connecting portion only on another part thereof facing the lower portion 19 of the conductive shell 14, the second grounding contact 24 provided on the conductive shell 14 is operative to come into contact with the part of the FPC facing the upper portion 15 of the conductive shell 14 and the first grounding contact 23 provided on the conductive shell 14 is operative to come into contact with the ground connecting portion provided on the part of the FPC facing the lower portion 19 of the conductive shell 14.

With the first and second grounding contacts 23 and 24 thus described, the ground connecting portions provided on the FPC inserted in the housing 11 are electrically connected through the conductive shell 14 with the grounded portion provided on the solid circuit board on which the housing 11 is mounted.

Further, the conductive shell 14 is provided at its left end portion in the vicinity of the left side portion 20 with a holding member 26 extending through a hanging portion 25 from the rear end of the upper portion 15 of the conductive shell 14 to the inside of the conductive shell 14 and a releasing member 27 extending further from the holding member 26 to project to the outside of the conductive shell 14 and also provided at its right end portion in the vicinity of the right side portion 21 with a holding member 28 extending through another hanging portion 25 from the rear end of the upper portion 15 of the conductive shell 14 to the inside of the conductive shell 14 and a releasing member 29 extending further from the holding member 28 to project to the outside of the conductive shell 14. The holding members 26 and 28 and the releasing members 27 and 29 are formed in a body in the conductive shell 14.

Figure 7:
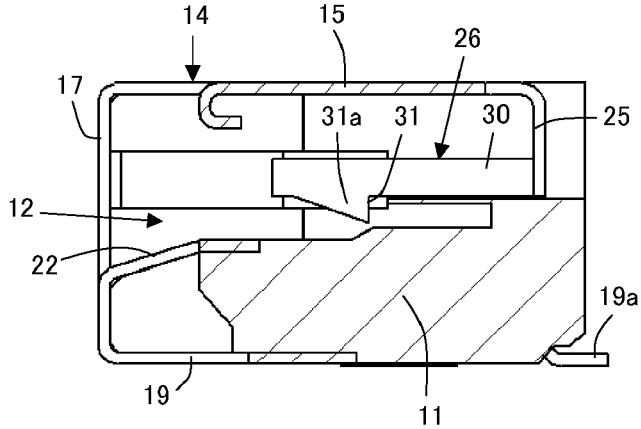
FIG. 7 is a schematic cross sectional view taken along line VII-VII on FIG. 3.
Figure 8:
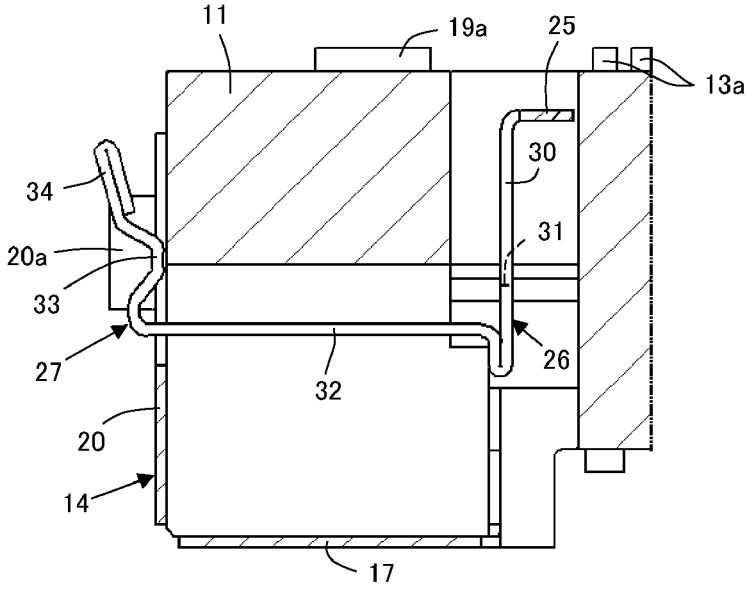
FIG. 8 is a schematic cross sectional view taken along line VIII-VIII on FIG. 3.

As shown clearly in FIG. 7 showing a cross section taken along line VII-VII on FIG. 3 and in FIG. 8 showing a cross section taken along line VIII-VIII on FIG. 3, the holding member 26 comprises a resilient movable arm portion 30 extending from the hanging portion 25 formed in the conductive shell 14 to the inside of the housing 11 and an engaging projection 31 provided at an end of the resilient movable arm portion 30 to be operative to engage with an engaging edged recess provided on the FPC inserted in the housing 11. The engaging projection 31 has a contacting surface 31*a* for coming into contact with an edge of the FPC when the FPC is inserted through the opening 12 into the housing 11. When the engaging projection 31 engages with the engaging edged recess provided on the FPC inserted in the housing 11, the holding member 26 is put in engagement with the FPC for holding the same.

The holding member 28 comprises a resilient movable arm portion 35 extending from the hanging portion 25 formed in the conductive shell 14 to the inside of the housing 11 and an engaging projection 36 provided at an end of the resilient movable arm portion 35 to be operative to engage with an engaging edged recess provided on the FPC inserted in the housing 11, in the same manner as the holding member 26, as shown in FIG. 5. The engaging projection 36 has a contacting surface 36*a* for coming into contact with an edge of the FPC when the FPC is inserted through the opening 12 into the housing 11. When the engaging projection 36 engages with the engaging edged recess provided on the FPC inserted in the housing 11, the holding member 28 is put in engagement with the FPC for holding the same.

Figure 9:
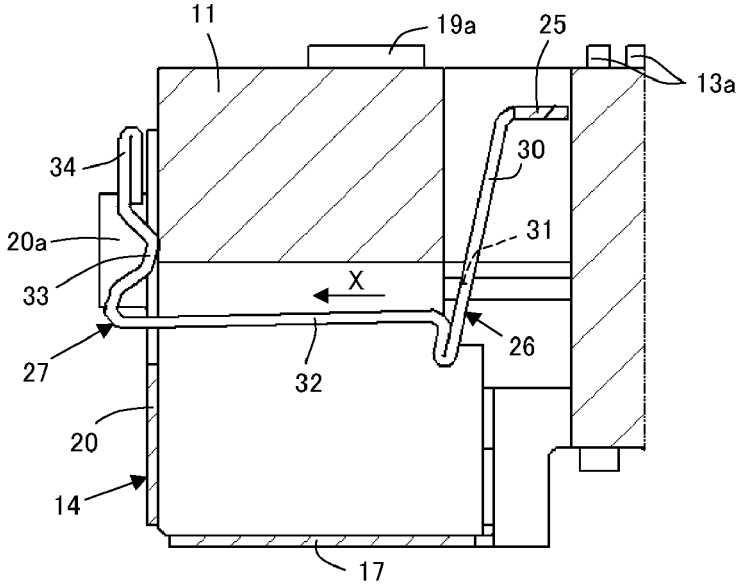
FIG. 9 is a schematic cross sectional view used for explaining a holding member and a releasing member employed in the embodiment shown in each of FIGS. 1 and 2.

Further, as shown clearly in FIG. 8, the releasing member 27 comprises a connecting portion 32 extending from the end of resilient movable arm portion 30 of the holding member 26, a contacting portion 33 supported by the connecting portion 32 to be positioned on the outside of the housing 11 for coming into contact with an outer surface of the left side end portion of the housing 11 and a handle portion 34 extending from the contacting portion 33 on the outside of the housing 11. As shown in FIG. 9, the handle portion 34 is operative to be pressed toward the housing 11 for releasing the holding member 26 from the engagement with the FPC inserted in the housing 11. When the handle portion 34 of the releasing member 27 is pressed toward the housing 11 under a condition wherein the FPC is inserted in the housing 11, the releasing member 27 with the contacting portion 33 in contact with the outer surface of the left side end portion of the housing 11 causes the connecting portion 32 to shift, together with the engaging projection 31 of the holding member 26, in a direction shown with an arrow X in FIG. 9 along an upper surface of the FPC inserted in the housing 11 so as to go away from the edge of the FPC.

Although the contacting portion 33 of the releasing member 27 is operative to come into contact with the outer surface of the left side end portion of the housing 11 in the embodiment shown in FIG. 9, it is also possible for the contacting portion 33 of the releasing member 27 to come into contact with an outer surface of the left side portion 20 of the conductive shell 14, for example, in the case where the left side portion 20 of the conductive shell 14 covers over the left side end portion of the housing 11.

The releasing member 29 comprises a connecting portion 37 extending from the end of resilient movable arm portion 35 of the holding member 28, a contacting portion 38 supported by the connecting portion 37 to be positioned on the outside of the housing 11 for coming into contact with an outer surface of the right side end portion of the housing 11 and a handle portion 39 extending from the contacting portion 38 on the outside of the housing 11, in the same manner as the releasing member 28, as shown in FIGS. 2 and 5. The handle portion 39 is operative to be pressed toward the housing 11 for releasing the holding member 28 from the engagement with the FPC inserted in the housing 11. When the handle portion 39 of the releasing member 29 is pressed toward the housing 11 under the condition wherein the FPC is inserted in the housing 11, the releasing member 29 with the contacting portion 38 in contact with the outer surface of the right side end portion of the housing 11 causes the connecting portion 37 to shift, together with the engaging projection 36 of the holding member 28, in a direction opposite to the direction shown with the arrow X in FIG. 9 along the upper surface of the FPC inserted in the housing 11 so as to go away from an edge of the FPC.

Although the contacting portion 38 of the releasing member 29 is operative to come into contact with the outer surface of the right side end portion of the housing 11 in the embodiment mentioned above, it is also possible for the contacting portion 38 of the releasing member 29 to come into contact with an outer surface of the right side portion 21 of the conductive shell 14, for example, in the case where the right side portion 21 of the conductive shell 14 covers over the right side end portion of the housing 11.

Figure 10:
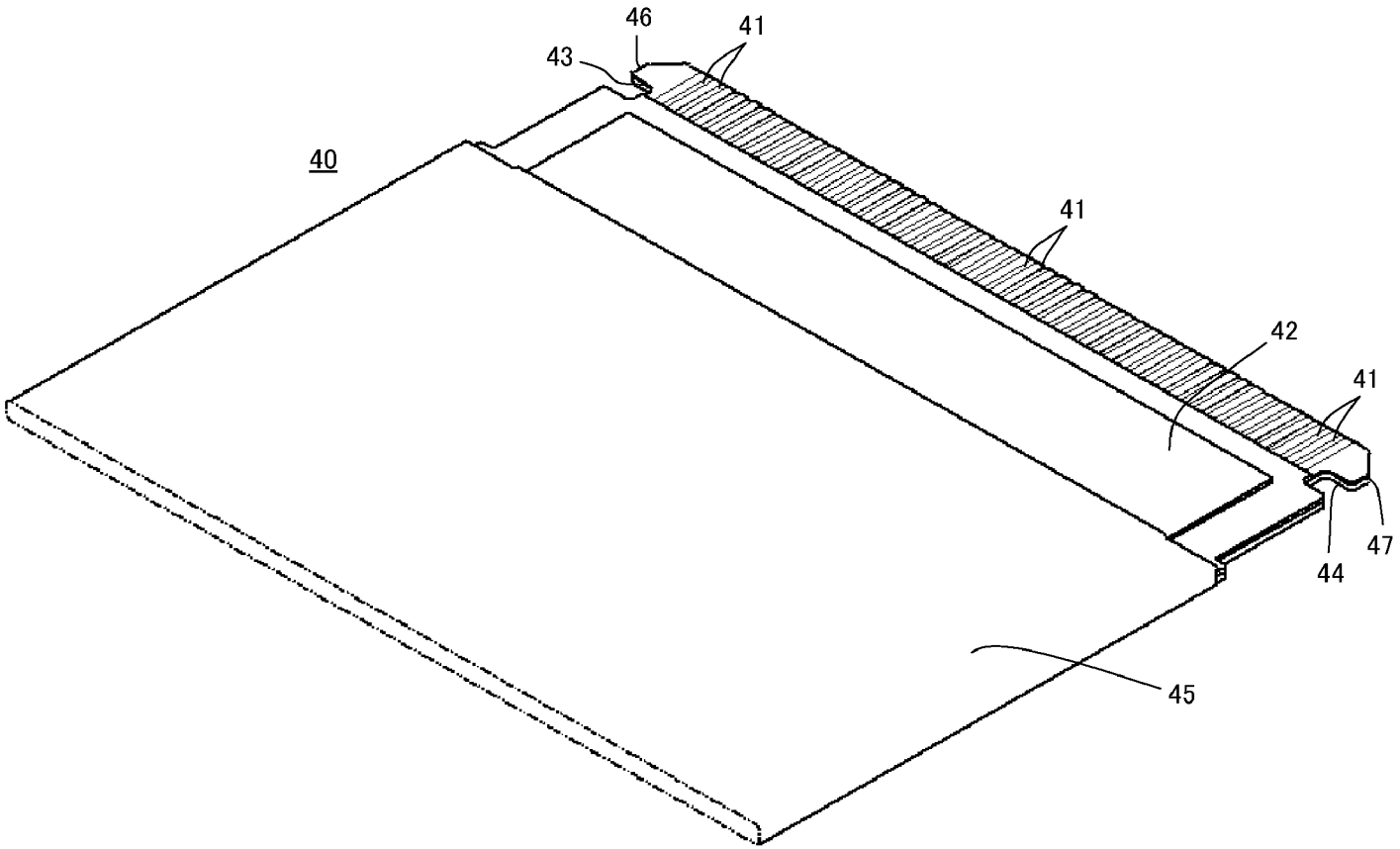
FIG. 10 is a schematic perspective view showing an FPC which is to be inserted into a housing of the embodiment shown in each of FIGS. 1 and 2.

FIG. 10 shows an FPC 40 which is an example of the FPC constituting the flat circuit device to be inserted into the housing 11 of the electrical connector 10 through the opening 12 provided on the housing 11.

Referring to FIG. 10, a plurality of signal connecting terminals 41 each made of conductive material and formed into a rectangular plate member are provided on a first surface opposite to a second surface of the FPC 40 to be arranged at a top end portion of the first surface. A ground connecting portion 42 is also provided on the first surface of the FPC 40 on which the signal connecting terminals 41 are provided on the outside of the ground connecting portion 42. Further, a pair of engaging edged recesses 43 and 44 are provided respectively on side end portions of the FPC 40 which are opposite each other with the signal connecting terminals 41 and the ground connecting portion 42 between. It is possible to provide the FPC with a pair of engaging edged holes in place of the engaging edged recesses 43 and 44. The FPC 40 is wrapped with a covering film 45 except a portion thereof on which the signal connecting terminals 41, a part of the ground connecting portion 42 and the engaging edged recesses 43 and 44 are provided.

Although the FPC 40 shown in FIG. 10 is provided with the signal connecting terminals 41 and the ground connecting portion 42 only on the first surface opposite to the second surface, it is also possible to use an FPC which is provided with a plurality of signal connecting terminals corresponding to the signal connecting terminals 41 on one of first and second surfaces opposite each other and with a ground connecting portion corresponding to the ground connecting portion 42 on the other of the first and second surfaces, as the flat circuit device provided to be inserted into the housing 11.

Figure 11:
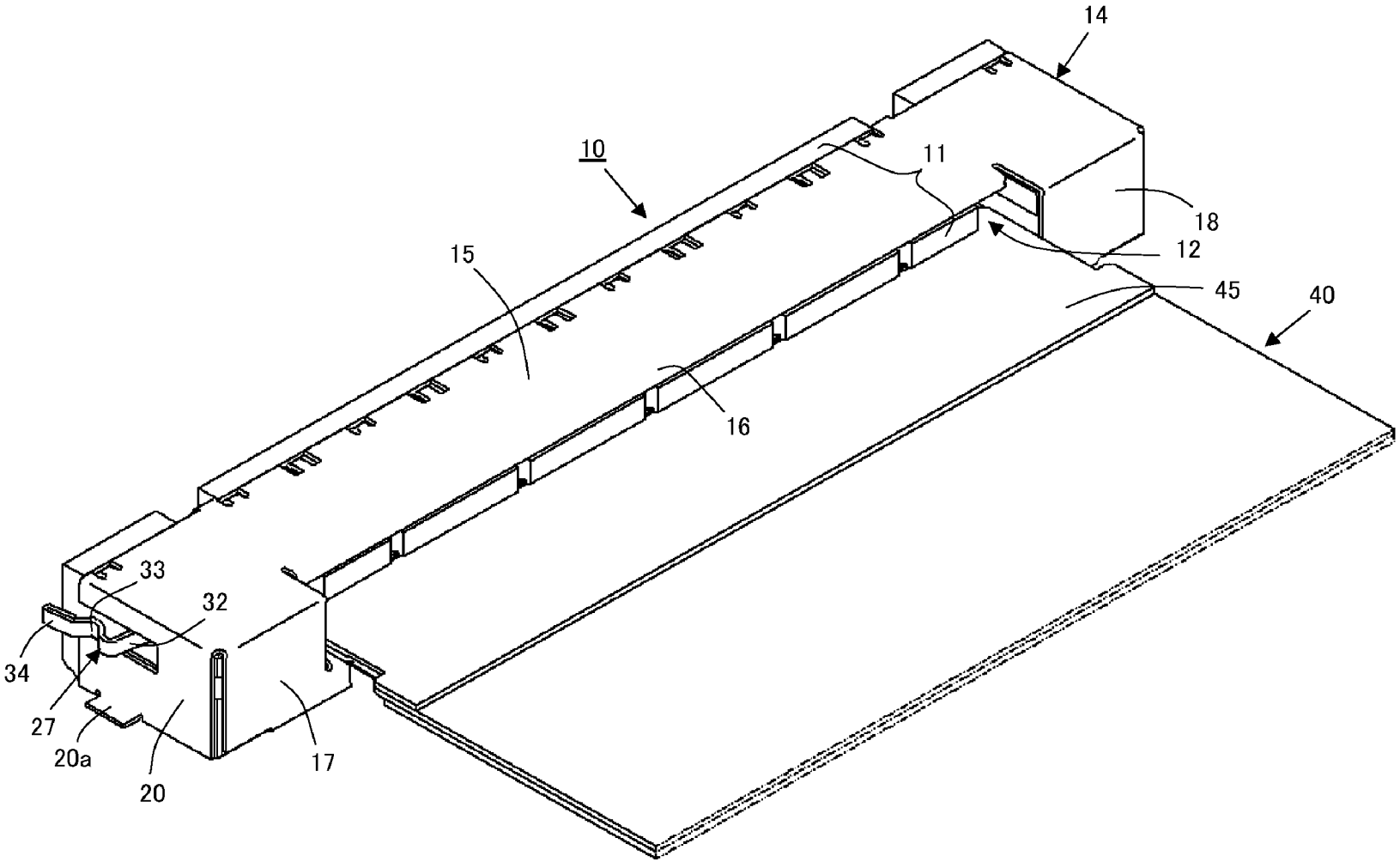
FIG. 11 is a schematic perspective view showing a situation wherein the FPC is put in insertion into the embodiment shown in each of FIGS. 1 and 2.

FIG. 11 shows the electrical connector 10 and the FPC 40 which is on the way to be inserted into the housing 11 of the electrical connector 10 through the opening 12 provided on the housing 11. In FIG. 11, the first surface of the FPC 40, on which the signal connecting terminal 41 and the ground connecting portion 42 are provided, faces downward to be not shown, and the second surface of the FPC 40, on which any signal connecting terminal or ground connecting portion is not provided, faces upward to be shown. A top end of a part of the FPC 40 on which the signal connecting terminal 41 are provided is postured to be parallel with the rear end portion of the housing 11 in a condition wherein the FPC 40 is properly inserted into the housing 11 through the opening 12 provided on the housing 11.

Figure 12:
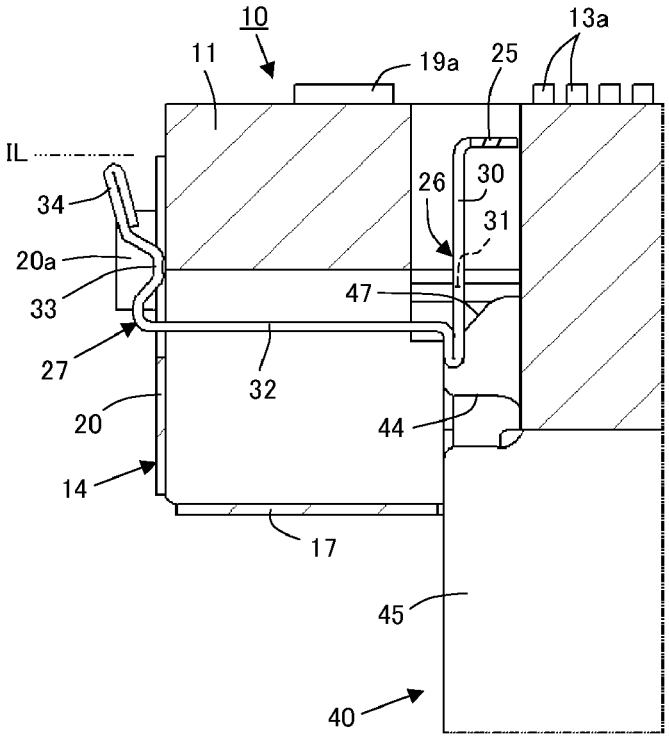
FIG. 12 is a schematic partial cross sectional view showing the situation wherein the FPC is put in insertion into the embodiment shown in each of FIGS. 1 and 2.

When the FPC 40 is inserted into the housing 11 of the electrical connector 10 through the opening 12 provided on the housing 11, as shown in FIG. 11, first an edge 47 of the FPC 40 provided on the outside of the engaging edged recess 44 as shown in FIG. 10 approaches the contacting surface 31*a* provided on the engaging projection 31 of the holding member 26, as shown in FIG. 12, and simultaneously an edge 46 of the FPC 40 provided on the outside of the engaging edged recess 43 as shown in FIG. 10 approaches the contacting surface 36*a* provided on the engaging projection 36 of the holding member 28. On that occasion, the handle portion 34 of the releasing member 27 is positioned not to reach an imaginary reference line IL shown in FIG. 12 and the handle portion 39 of the releasing member 27 is also positioned not to reach a rightward extension of the imaginary reference line IL.

Figure 13:
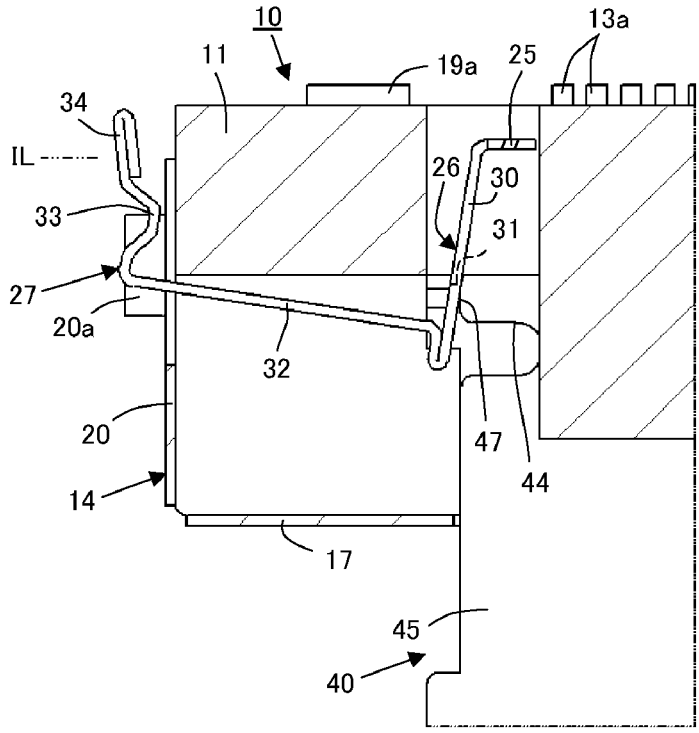
FIG. 13 is a schematic partial cross sectional view showing the situation wherein the FPC is put in insertion into the embodiment shown in each of FIGS. 1 and 2.

Then, with the FPC 40 inserted continuously into the housing 11, the contacting surface 31*a* provided on the engaging projection 31 of the holding member 26 comes into contact with the edge 47 of the FPC 40, as shown in FIG. 13, and thereby the engaging projection 31 causes the resilient movable arm portion 30 of the holding member 26 to shift along the second surface of the FPC 40 so as to go away from the FPC 40. Simultaneously with this, the contacting surface 36*a* provided on the engaging projection 36 of the holding member 28 comes into contact with the edge 46 of the FPC 40 and thereby the engaging projection 36 causes the resilient movable arm portion 35 of the holding member 28 to shift along the second surface of the FPC 40 so as to go away from the FPC 40. As a result, the insertion of the FPC 40 into the housing 11 is able to be smoothly continued without being impeded by the holding members 26 and 28.

Further, the connecting portion 32 of the releasing member 27 connected with the resilient movable arm portion 30 of the holding member 26 is shifted along the second surface of the FPC 40 inserted in the housing 11 so as to go away from the FPC 40 and this movement of the connecting portion 32 causes the handle portion 34 of the releasing member 27 to shift beyond the imaginary reference line IL on the outside of the housing 11, as shown in FIG. 13. Simultaneously, the connecting portion 37 of the releasing member 29 connected with the resilient movable arm portion 35 of the holding member 28 is also shifted along the second surface of the FPC 40 inserted in the housing 11 so as to go away from the FPC 40 and this movement of the connecting portion 37 causes the handle portion 39 of the releasing member 29 to shift beyond the rightward extension of the imaginary reference line IL.

With the handle portion 34 of the releasing member 27 and the handle portion 39 of the releasing member 29 thus shifted beyond the imaginary reference line IL and the rightward extension of the imaginary reference line IL, respectively, it can be easily confirmed by means of checking visually or sentiently the position of each of the handle portions 34 and 39 from the outside of the electrical connector 10 that the contacting surface 31*a* provided on the engaging projection 31 of the holding member 26 is in contact with the edge 47 of the FPC 40 inserted in the housing 11 so that the engaging projection 31 of the holding member 26 does not engage with the engaging edged recess 44 provided on the FPC 40 and the contacting surface 36*a* provided on the engaging projection 36 of the holding member 28 is in contact with the edge 46 of the FPC 40 inserted in the housing 11 so that the engaging projection 36 of the holding member 28 does not engage with the engaging edged recess 43 provided on the FPC 40.

After that, the FPC 40 is further inserted into the housing 11 to reach a predetermined appropriate position in the housing 11. When the FPC 40 has reached the predetermined appropriate position in the housing 11, the insertion of the FPC 40 into the housing 11 is completed, as shown in FIG. 14.

Figure 15:
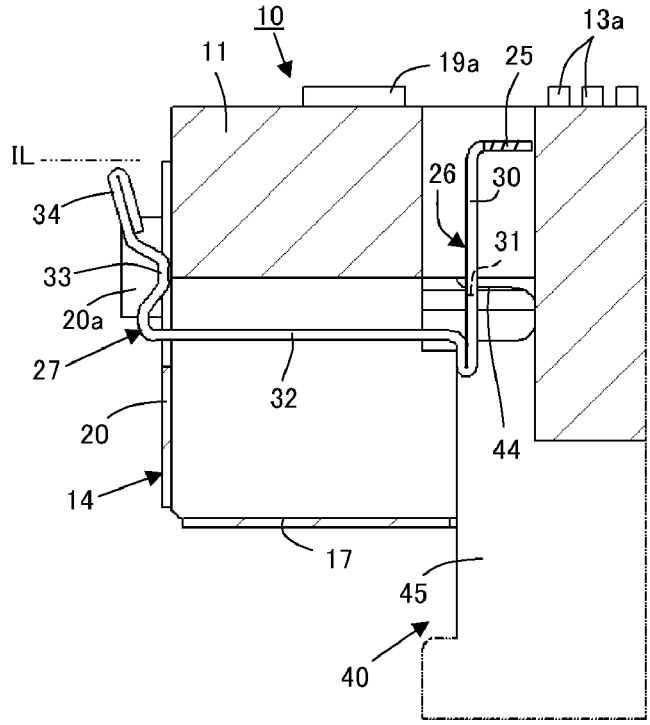
FIG. 15 is a schematic partial cross sectional view showing the situation wherein the FPC has been correctly inserted into the embodiment shown in each of FIGS. 1 and 2.
Figure 14:
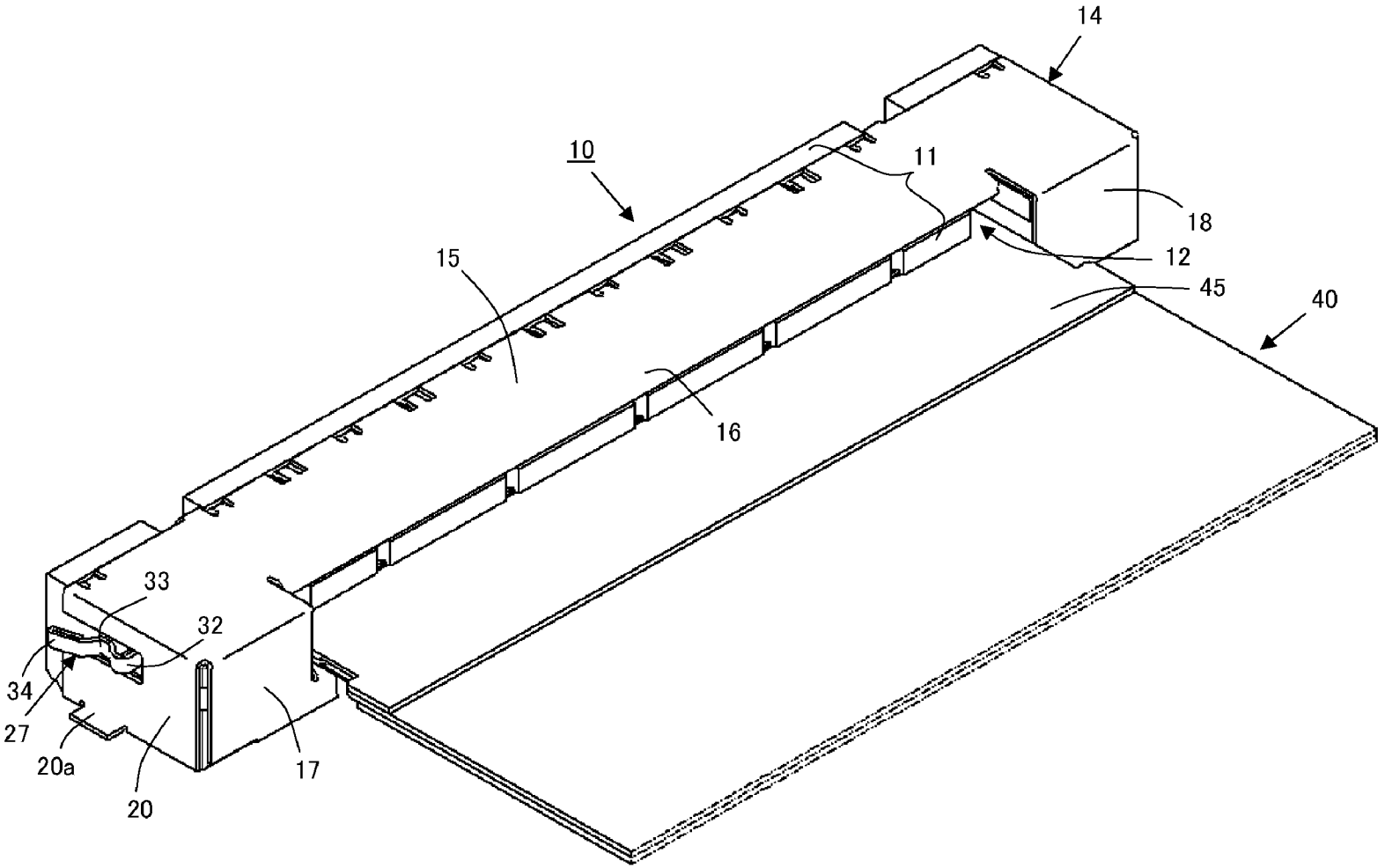
FIG. 14 is a schematic perspective view showing a situation wherein the FPC has been correctly inserted into the embodiment shown in each of FIGS. 1 and 2.
Figure 16:
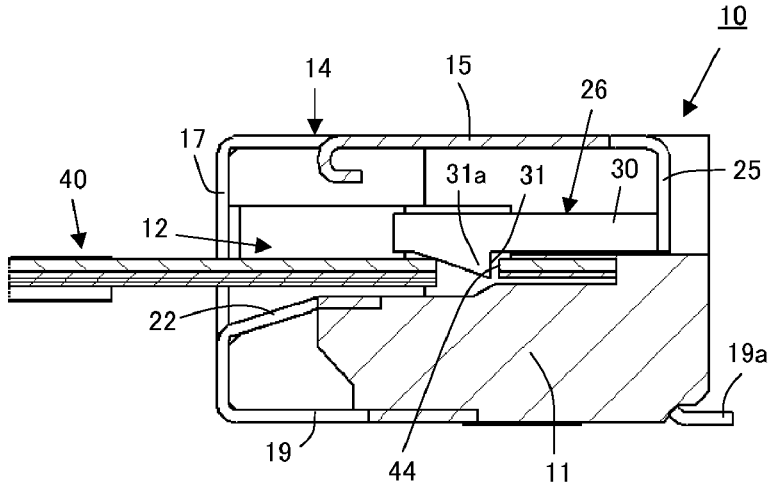
FIG. 16 is a schematic partial cross sectional view showing a situation wherein the FPC inserted in the embodiment shown in each of FIGS. 1 and 2 is put in holding by the holding member.

When the FPC 40 is completely inserted into the housing 11 as shown in FIG. 14, the contacting surface 31*a* provided on the engaging projection 31 of the holding member 26 gets out of contact with the edge 47 of the FPC 40 and thereby the resilient movable arm portion 30 of the holding member 26 supporting the engaging projection 31 shifts along the second surface of the FPC 40 inserted in the housing 11 in a direction toward the FPC 40 and causes the engaging projection 31 to engage with the engaging edged recess 44 provided on the FPC 40, as shown in FIGS. 15 and 16. Further, the contacting surface 36*a* provided on the engaging projection 36 of the holding member 28 also gets out of contact with the edge 46 of the FPC 40 and thereby the resilient movable arm portion 35 of the holding member 28 supporting the engaging projection 36 shifts along the second surface of the FPC 40 inserted in the housing 11 in a direction toward the FPC 40 and causes the engaging projection 36 to engage with the engaging edged recess 43 provided on the FPC 40. As a result, the holding members 26 and 28 are put in engagement with the FPC 40 inserted in the housing 11 for holding the same, so that the FPC 40 is prevented from getting out of the housing 11 unwillingly.

On that occasion, the connecting portion 32 of the releasing member 27 connected with the resilient movable arm portion 30 of the holding member 26 is shifted along the second surface of the FPC 40 inserted in the housing 11 so as to approach the FPC 40 and this movement of the connecting portion 32 causes the handle portion 34 of the releasing member 27 to shift not to reach the imaginary reference line IL from the position beyond the imaginary reference line IL shown in FIG. 13 on the outside of the housing 11, as shown in FIG. 15. Simultaneously, the connecting portion 37 of the releasing member 29 connected with the resilient movable arm portion 35 of the holding member 28 is shifted along the second surface of the FPC 40 inserted in the housing 11 so as to approach the FPC 40 and this movement of the connecting portion 37 causes the handle portion 39 of the releasing member 29 to shift not to reach the rightward extension of the imaginary reference line IL from the position beyond the rightward extension of the imaginary reference line IL on the outside of the housing 11.

With the handle portion 34 of the releasing member 27 and the handle portion 39 of the releasing member 29 thus shifted not to beyond the imaginary reference line IL and the rightward extension of the imaginary reference line IL, respectively, it can be confirmed by means of checking visually or sentiently the position of each of the handle portions 34 and 39 from the outside of the electrical connector 10 that the holding members 26 and 28 are put in engagement with the FPC 40 for holding the same.

Under a condition wherein the FPC 40 inserted in the housing 11 through the opening 12 provided thereon takes up the predetermined appropriate position in the housing 11 so as to be held by the holding members 26 and 28 in such a manner as described above, each of the conductive contacts 13 arranged in the housing 11 comes into press-contact with a corresponding one of the signal connecting terminals 41 provided on the FPC 40, which is inserted in the housing 11 with its surfaces provided thereon with the signal connecting terminal 41 and the ground connecting portion 42 and facing downward, from the side of the lower portion 19 of the conductive shell 14. As a result, the signal connecting terminals 41 provided on the FPC 40 inserted in the housing 11 are electrically connected through the conductive contacts 13 with the signal terminals provided on the solid circuit board on which the housing 11 is mounted.

Further, each of the first grounding contacts 23 extending from the lower portion 19 of the conductive shell 14 into the housing 11 to be positioned at the opening 12 comes into press-contact with the ground connecting portion 42 provided on the FPC 40 inserted in the housing 11 from the side of the lower portion 19 of the conductive shell 14. As a result, the ground connecting portion 42 provided on the FPC 40 inserted in the housing 11 is electrically connected through the first grounding contacts 23 with the grounded portion provided on the solid circuit board on which the housing 11 is mounted.

After that, with operations for pressing each of the handle portion 34 of the releasing member 27 and the handle portion 39 of the releasing member 29 toward the housing 11, the FPC 40 inserted in the housing 11 is put in a condition to be caused intentionally to get out of the housing 11.

Figure 17:
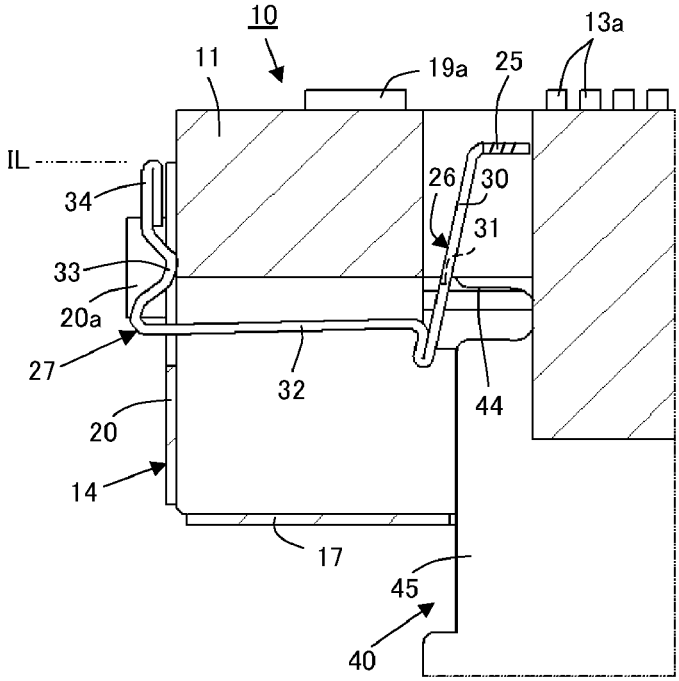
FIG. 17 is a schematic partial cross sectional view showing a situation wherein the releasing member causes the holding member to release the FPC inserted in the embodiment shown in each of FIGS. 1 and 2 from the holding thereby.

When the handle portion 34 of the releasing member 27 is pressed toward the housing 11, as shown in FIG. 17, the releasing member 27 causes the contacting portion 33 of the releasing member 27 to come into contact with the outer surface of the left end portion of the housing 11 (or the outer surface of the left side portion 20 of the conductive shell 14) and causes also the connecting portion 32 of the releasing member 27 and the engaging projection 31 of the holding member 26 to shift along the second surface of the FPC 40 inserted in the housing 11 so as to go away from the FPC 40, so that the engaging projection 31 of the holding member 26 is released from the engagement with the engaging edged recess 44 provided on the FPC 40 inserted in the housing 11.

Similarly, when the handle portion 39 of the releasing member 29 is pressed toward the housing 11, the handle portion 39 causes the contacting portion 38 of the releasing member 29 to come into contact with the outer surface of the right end portion of the housing 11 (or the outer surface of the right side portion 21 of the conductive shell 14) and causes also the connecting portion 37 of the releasing member 29 and the engaging projection 36 of the holding member 28 to shift along the second surface of the FPC 40 inserted in the housing 11 so as to go away from the FPC 40, so that the engaging projection 36 of the holding member 28 is released from the engagement with the engaging edged recess 43 provided on the FPC 40 inserted in the housing 11.

As a result, the FPC 40 inserted in the housing 11 is released from the holding by the holding members 26 and 28 and put in the condition to be caused intentionally to get out of the housing 11.

With the electrical connector 10 thus constituted as the embodiment of electrical connector according to the present invention, the FPC 40 inserted in the housing 11 can be put in the holding by the holding members 26 and 28 to be surely prevented from getting out of the housing 11 unwillingly and then released from the holding by the holding members 26 and 28 to be caused intentionally to get out of the housing 11 with an improved structure in which the holding members 26 and 28 and the releasing members 27 and 29 are formed in a body in the conductive shell 14 so that the number of structural parts can be reduced.

Further, in the electrical connector 10, the position on the outside of the housing 11, at which the handle portion 34 of the releasing member 27 formed in a body in the conductive shell 14 is put when the engaging projection 31 of the holding member 26 formed in a body in the conductive shell 14 is put in the engagement with the engaging edged recess 44 provided on the FPC 40 so that the holding member 26 is put in the condition to hold the FPC 40, is different from the position on the outside of the housing 11, at which the handle portion 34 of the releasing member 27 is put when the engaging projection 31 of the holding member 26 is released from the engagement with the engaging edged recess 44 provided on the FPC 40 so that the holding member 26 is out of the condition to hold the FPC 40, and the position on the outside of the housing 11, at which the handle portion 39 of the releasing member 29 formed in a body in the conductive shell 14 is put when the engaging projection 36 of the holding member 28 formed in a body in the conductive shell 14 is put in the engagement with the engaging edged recess 43 provided on the FPC 40 so that the holding member 28 is put in the condition to hold the FPC 40, is different from the position on the outside of the housing 11, at which the handle portion 39 of the releasing member 29 is put when the engaging projection 36 of the holding member 28 is released from the engagement with the engaging edged recess 43 provided on the FPC 40 so that the holding member 28 is out of the condition to hold the FPC 40. Consequently, it can be easily, quickly and accurately confirmed by means of visual check or sentient check from the outside of the electrical connector 10 that the FPC inserted in the housing 11 has reached the predetermined appropriate position in the housing 11 to be surely prevented from getting out of the housing 11 unwillingly by the holding members 26 and 28 formed in the conductive shell 14.

Incidentally, although the FPC 40 is inserted in the housing 11 with its first surface provided thereon with the signal connecting terminal 41 and the ground connecting portion 42 and facing downward under a condition wherein a contacting part of each of the conductive contacts 13 provided for coming into contact with the signal connecting terminal 41 provided on the FPC 40 is arranged to project upward from the bottom end portion of the housing 11, in the electrical connector 10 described above, it is also possible to modify the electrical connector 10 in such a manner that the FPC 40 is inserted in the housing 11 with its first surface provided thereon with the signal connecting terminal 41 and the ground connecting portion 42 and facing upward under a condition wherein the contacting part of each of the conductive contacts 13 provided for coming into contact with the signal connecting terminal 41 provided on the FPC 40 is arranged to project downward from the upper end portion of the housing 11.

What is claimed is:

1. An electrical connector comprising;

a housing provided thereon with an opening through which a flat circuit device is inserted into the housing, a plurality of conductive contacts provided to be arranged on the housing and positioned to correspond respectively to connecting terminals provided on the flat circuit device inserted in the housing through the opening provided thereon, and a conductive shell mounted on the housing for covering partially the same and provided with a holding member formed in a body therein and operative to be put in engagement with the flat circuit device inserted in the housing for holding the same and a releasing member formed in a body therein and operative to release the holding member from the engagement with the flat circuit device inserted in the housing, wherein the holding member formed in the conductive shell comprises an arm portion extending from the conductive shell to the inside of the housing and an engaging projection provided at an end of the arm portion for engaging with an engaging edged portion provided on the flat circuit device, and the releasing member formed in the conductive shell comprises a connecting portion extending from the end of the arm portion, a contacting portion supported by the connecting portion to be positioned on the outside of the housing for coming into contact with an outer surface of one of the housing and the conductive shell and a handle portion extending from the contacting portion on the outside of the housing and operative to be handled for releasing the holding member from the engagement with the flat circuit device inserted in the housing.

2. An electrical connector according to claim 1, wherein the arm portion of the holding member is formed to be resilient and movable.

3. An electrical connector according to claim 1, wherein the enga-ging projection of the holding member is provided thereon with a contacting surface for coming into contact with an edge of the flat circuit device when the flat circuit device is inserted through the opening into the housing and operative to shift the arm portion of the holding member along a surface of the flat circuit device inserted in the housing so as to go away from the flat circuit device when the contacting surface comes into contact with the edge of the flat circuit device.

4. An electrical connector according to claim 3, wherein the connecting portion of the releasing member is operative to shift along the surface of the flat circuit device inserted in the housing so as to go away from the flat circuit device and to cause the handle portion of the releasing member to shift its position on the outside of the housing when the contacting surface provided on the engaging projection of the holding member comes into contact with the edge of the flat circuit device inserted in the housing.

5. An electrical connector according to claim 3, wherein the arm portion of the holding member is operative to shift along the surface of the flat circuit device inserted in the housing so as to approach the flat circuit device and to cause the engaging projection of the holding member to engage with the engaging edged portion provided on the flat circuit device inserted in the housing when the contacting surface provided on the engaging projection of the holding member gets out of contact with the edge of the flat circuit device inserted in the housing.

6. An electrical connector according to claim 1, wherein the releasing member is operative to cause the contacting portion of the releasing member to come into contact with the outer surface of one of the housing and the conductive shell and to cause also the connecting portion of the releasing member and the engaging projection of the holding member to shift along a surface of the flat circuit device inserted in the housing so as to go away from the flat circuit device inserted in the housing, so that the engaging projection of the holding member is released from engagement with the engaging edged recess provided on the flat circuit device inserted in the housing, when the handle portion of the releasing member is pressed toward the housing.

7. An electrical connector according to claim 1, wherein a group of the holding member and the releasing member is provided at each of portions of the conductive shell corresponding respectively to end portions of the housing opposite each other in a direction along which the conductive contacts are arranged.

* * * * *